US007735231B2

(12) United States Patent
Schardt

(10) Patent No.: US 7,735,231 B2
(45) Date of Patent: Jun. 15, 2010

(54) CHALK LINE END FASTENER

(76) Inventor: David M Schardt, 3295 S. Ellen St., Milwaukee, WI (US) 53207

( * ) Notice: Subject to any disclaimer, the term of this patent is extended or adjusted under 35 U.S.C. 154(b) by 0 days.

(21) Appl. No.: 12/267,379

(22) Filed: Nov. 7, 2008

(65) Prior Publication Data

US 2010/0115782 A1 May 13, 2010

(51) Int. Cl.
*B44D 3/38* (2006.01)

(52) U.S. Cl. ..... 33/414; 33/758

(58) Field of Classification Search ..... 33/413, 33/414, 755, 756, 759, 760
See application file for complete search history.

(56) References Cited

U.S. PATENT DOCUMENTS

| | | | | | |
|---|---|---|---|---|---|
| 70,684 | A * | 11/1867 | Bathgate | 33/414 |
| 558,113 | A * | 4/1896 | Rodick | 33/758 |
| 841,272 | A * | 1/1907 | Read | 33/758 |
| 3,122,836 | A * | 3/1964 | Aciego | 33/413 |
| 4,697,349 | A * | 10/1987 | Lee | 33/27.03 |
| 5,937,532 | A * | 8/1999 | Eirich et al. | 33/758 |
| 6,138,370 | A * | 10/2000 | Rolfe | 33/407 |
| 6,415,519 | B1 * | 7/2002 | Bennett | 33/414 |
| 6,705,018 | B2 * | 3/2004 | Guhse | 33/414 |
| 6,931,743 | B1 * | 8/2005 | Scarborough | 33/414 |

* cited by examiner

*Primary Examiner*—G. Bradley Bennett
*Assistant Examiner*—Tania C Courson

(57) ABSTRACT

This Chalk Line End Fastener, is a hook similar in size to the conventional hooks but is cylindrical and narrower, coming to a sharp point. This pointed hook can still be used in the prior art manner, but more effectively can be pushed into most surfaces without the use of additional tools, fasteners, or a helper to hold the end of the line securely in place. The design of the front of the body of this invention allows for maximization of surface area, which eases any pressure on the user's fingers as they push the point into a material to secure the chalk line. The rear of the body is designed to allow the user to lift straight up on the chalk line and easily disengage the point. There is also a lip at the back of the body which allows the user to pry the point straight out.

1 Claim, 1 Drawing Sheet

CHALK LINE END FASTENER

CROSS-REFERENCE TO RELATED APPLICATIONS

Not Applicable

BACKGROUND/TECHNICAL FIELD OF THE INVENTION

The present invention relates to hand tools in general, and more specifically, to a chalk line end.

Current technology/prior arts require an edge to secure the end of the chalk box line. This invention allows a single operator to easily mark chalk lines whether or not an edge is available.

Prior art chalk line ends hook over the edge of a board providing an anchor point for marking chalk lines on said board. If the edge of a board is not available as an anchor, attempts to mark a chalk line are tedious and less efficient and the line will most likely not stay put in the desired location without extra effort (for example: require driving a nail into the board to hook the chalk line end onto, or cutting a notch in the board to secure the chalk line end, or having a helper hold the end of the chalk line to keep it in place). Prior patents granted for this art do not solve the problem of securing a chalk line end to a surface that does not have an accessible edge.

BRIEF SUMMARY OF THE INVENTION

This design replaces the conventional/prior art wide, flat hook with a stronger and smaller pointed hook. This invention, the design of which still offers the function attaching the end to the edge of a board, more importantly allows a single operator to push the stronger and smaller pointed hook into most surfaces to provide an anchor point without the use of additional tools, fasteners or a helper allowing virtually unlimited flexibility with regard where the chalk line end can be secured to snap a chalk line.

DETAILED DESCRIPTION OF THE INVENTION

Figure 1:
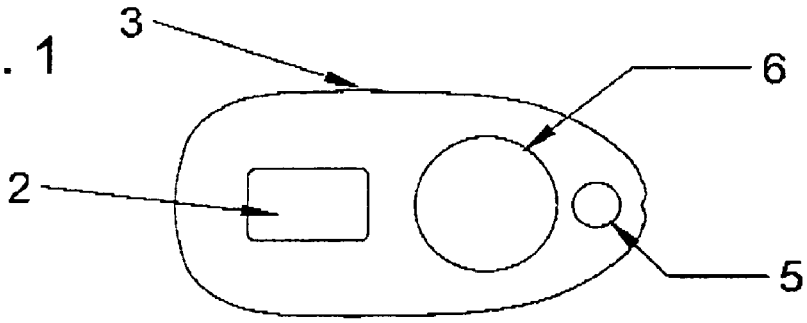
FIG. 1 is a top view of the preferred embodiment of the present invention.
Figure 2:
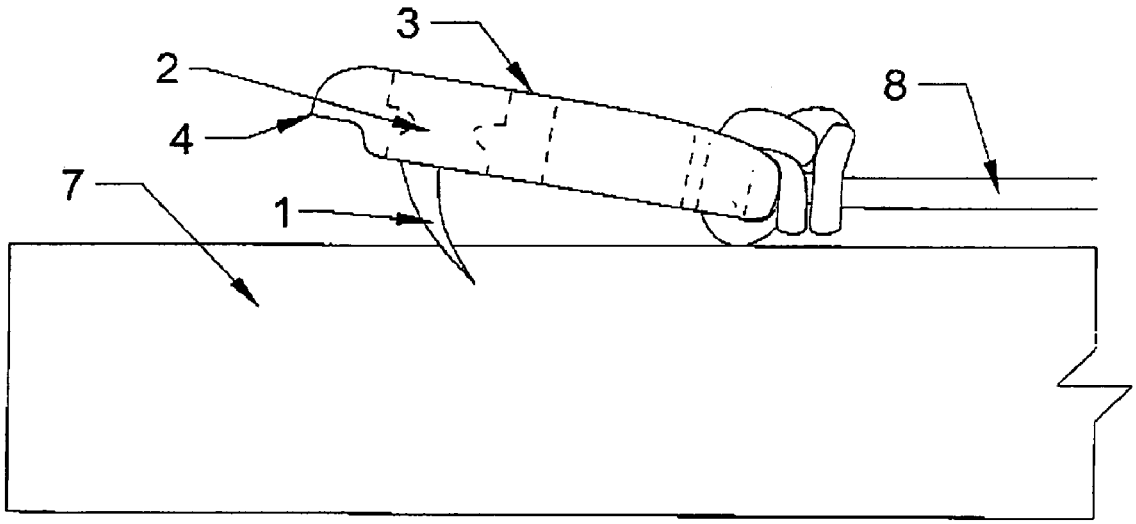
FIG. 2 is the side view of the preferred embodiment of the present invention.

The chalk line end of the present invention, in any of its alternative embodiments, illustrated in FIGS. 1 and 2, is a hook 1 preferably formed from high carbon steel (It should be noted that any material strong enough to hold the desired shape and to be pressed into surfaces requiring a snapped chalk line may be used). Though similar in size to the conventional (prior art) hooks, it comes to a sharp point. This pointed hook 1 can be pushed into most surfaces without the use of additional tools, fasteners, or a helper and, yet, can still be used in the conventional manner (hooked onto the edge of a board) if desired. The base 2 of this steel hook 1 is embedded in a body 3 constructed out of shatter-resistant material. The body 3 is designed to utilize maximum surface area as the operator pushes the hook 1 into a material 7, easing pressure on the operator's fingers. The rear of the body 3 is designed to allow the user to lift straight up on the line and remove the point of the hook 1 without any additional tools. There is a lip 4 at the back of the body 3 to allow the user to pry the point straight out of the surface of more dense materials 7 should this ever be necessary. A small hole 5 is provided to attach the chalk line 8 to the front of the body 3. This hole 5 is sized and shaped to prevent the line 8 from sliding to the side of the body 3. A second hole 6 is positioned behind the small hole 5 to allow the user to attach the body 3 to some other fastener, such a screw or nail, providing an alternate means of securing the chalk line end.

The illustrations and description of the chalk line end of the present invention are to be considered as illustrative and not restrictive in character, it being understood that only the preferred embodiment has been shown and described and that all changes and modifications that come within the spirit of the invention are desired to be protected.

What is claimed is:

1. A chalk line end fastener, consisting of:

a smooth pointed hook that can easily be pushed into a surface without the use of additional tools, fasteners, or a helper holding the end of the line; the hook is embedded in the body at a fixed angle so it further secures the point into the material when tension is applied to the line which is attached to a small hole at the opposite end of the body; a recessed lip in the body above the hook allows for ease of removal of the chalk line end fastener.

* * * * *